US010519982B2

(12) United States Patent
Danieli et al.

(10) Patent No.: US 10,519,982 B2
(45) Date of Patent: Dec. 31, 2019

(54) DE-BLOCKING DEVICE FOR A HYDRAULIC PUMP

(71) Applicant: Xylem IP Management S.à r.l., Senningerberg (LU)

(72) Inventors: Stefano Danieli, Valdagno (IT); Luigi D'Andrea, Thiene (IT)

(73) Assignee: XYLEM EUROPE GMBH, Schaffhausen (CH)

( * ) Notice: Subject to any disclaimer, the term of this patent is extended or adjusted under 35 U.S.C. 154(b) by 141 days.

(21) Appl. No.: 15/920,535

(22) Filed: Mar. 14, 2018

(65) Prior Publication Data

US 2018/0274560 A1 Sep. 27, 2018

(30) Foreign Application Priority Data

Mar. 23, 2017 (EP) ..... 17162489

(51) Int. Cl.

| | |
|---|---|
| ***F04D 29/043*** | (2006.01) |
| ***F04D 29/70*** | (2006.01) |
| ***F04D 29/046*** | (2006.01) |
| ***F04D 13/02*** | (2006.01) |

(52) U.S. Cl.

CPC ..... *F04D 29/708* (2013.01); *F04D 13/021* (2013.01); *F04D 29/043* (2013.01); *F04D 29/046* (2013.01)

(58) Field of Classification Search

None

See application file for complete search history.

(56) References Cited

U.S. PATENT DOCUMENTS 3,306,222 A 2/1967 Simcox
3,995,717 A * 12/1976 Kroffke ..... F16N 7/385 184/7.4
4,053,089 A * 10/1977 Gamadia ..... B05B 11/3035 222/207
4,072,442 A * 2/1978 Horiuchi ..... F04B 49/08 417/218
4,699,320 A * 10/1987 Sisson ..... F02M 57/024 239/90
5,788,465 A * 8/1998 Luongo ..... F04B 53/14 417/360

(Continued)

FOREIGN PATENT DOCUMENTS

DE 19548471 C1 6/1997

OTHER PUBLICATIONS

European Search Report dated Sep. 15, 2017 re: Application No. EP 17 16 2489; pp. 1-5; citing: US 2016/102715 A1, U.S. Pat. No. 3,306,222 A and DE 195 48 471 C1.

*Primary Examiner* — Michael Lebentritt
(74) *Attorney, Agent, or Firm* — Cantor Colburn LLP

(57) ABSTRACT

A de-blocking device for a hydraulic pump includes a can having a longitudinal axis and a conduit extending longitudinally along the longitudinal axis and having a first terminal aperture. The device further includes a bearing fixedly positioned in the conduit spaced from the first terminal aperture, and a plunger axially movably positioned in the conduit between the bearing and the first terminal aperture. A biasing element is positioned between the bearing and the plunger wherein the movement of the plunger toward the bearing compresses the biasing element.

15 Claims, 2 Drawing Sheets

(56) References Cited

U.S. PATENT DOCUMENTS

| | | | | |
|---|---|---|---|---|
| 6,062,926 | A * | 5/2000 | Alexander, Jr. | B63H 5/10 416/129 |
| 6,386,844 | B1 * | 5/2002 | Chen | F04D 13/06 415/214.1 |
| 9,488,277 | B2 * | 11/2016 | Shreve | F04B 1/0448 |
| 2014/0166138 | A1 * | 6/2014 | Bisig | F16K 15/025 137/625 |
| 2015/0060225 | A1 * | 3/2015 | Kimes | F16D 27/02 192/69 |
| 2015/0292493 | A1 * | 10/2015 | Suzuki | F04B 9/042 74/56 |
| 2016/0102715 | A1 * | 4/2016 | Nielsen | F04D 13/0626 310/68 R |
| 2017/0355243 | A1 * | 12/2017 | Albert | B60K 7/0015 |
| 2018/0283702 | A1 * | 10/2018 | Blad | F16K 11/048 |

* cited by examiner

DE-BLOCKING DEVICE FOR A HYDRAULIC PUMP

CROSS-REFERENCE TO RELATED APPLICATIONS

This application is related to, and claims the benefit of, European Patent Application No. 17162489.3, filed on Mar. 23, 2017, the contents of which are herein incorporated by reference in their entirety.

TECHNICAL FIELD

This disclosure relates generally to the field of hydraulic pump assemblies and in particular to de-blocking devices for hydraulic pump assemblies.

BACKGROUND

A hydraulic pump is a mechanical source of power that converts mechanical power into flow pressure. The hydraulic pump can be driven by an electrical drive motor. A flow is generated with sufficient power to overcome pressure induced by the load at the hydraulic pump outlet. In operation, the hydraulic pump creates a vacuum at the inlet thereby forcing liquid from the reservoir into the inlet line by mechanical action and delivers the liquid to the outlet and into the hydraulic system.

The hydraulic system may have a motor that is separated from a fluid filled rotor space. Over time the rotor may become blocked due to contamination in the fluid. Generally, the rotor may be unblocked by providing an axial screw at the axial end of the can wherein the screw can be used to with a tool to manually rotate the rotor shaft located in the can so as to unblock the rotor.

U.S. Pat. No. 3,306,222 discloses an electrically driven circulating pump. The pump comprises a detachable cover having a ferrule. The ferrule has a bearing sleeve mounted therein for the reception of an end of a rotor spindle. A turnable plug is slidably mounted within the ferrule. The plug has an inner end formed with a diametrical spigot which is pushed into register with and then into engagement with a complementary diametrical slot in the end of the rotor spindle. In the case of a sticking of the rotor of the electric motor the plug is pushed inwardly to engage with the slotted end portion of the rotor spindle so as to enable a twist to be imparted to the rotor spindle by engaging a tool within an external slot formed in the outer end of the said plug. The plug is maintained out of engagement with the rotor spindle by a coil spring housed within the said ferrule.

US2016/0102715 discloses an actuating device for a pump unit. The actuating device comprises an actuation pin having an axial and rotational movement. The de-blocking device is accessible from the outside through a channel. The actuating pin is used for releasing a blocked shaft in the inside of a can, by way of a linear force action or applying a torque, in order to release a blocking of the shaft in its bearings. The rotor lies in the inside of a can which separates the rotor from a stator arranged in the inside of the stator housing or of the motor housing.

The present disclosure is directed, at least in part, to improving or overcoming one or more aspects of the prior art system.

SUMMARY

The present disclosure describes a de-blocking device for a hydraulic pump is disclosed. The de-blocking device comprises a can having a longitudinal axis and a conduit extending longitudinally along the longitudinal axis, the conduit having a first terminal aperture; a bearing fixedly positioned in the conduit spaced from first terminal aperture, a plunger axially movably positioned in the conduit between the bearing and the first terminal aperture; and a biasing element positioned between the bearing and the plunger wherein the movement of the plunger toward the bearing compresses the biasing element.

BRIEF DESCRIPTION OF THE DRAWINGS

The foregoing and other features and advantages of the present disclosure will be more fully understood from the following description of various embodiments, when read together with the accompanying drawings, in which.

DETAILED DESCRIPTION OF THE DRAWINGS

This disclosure generally relates to a de-blocking device for de-blocking a blocked rotor in a pump.

Figure 1:
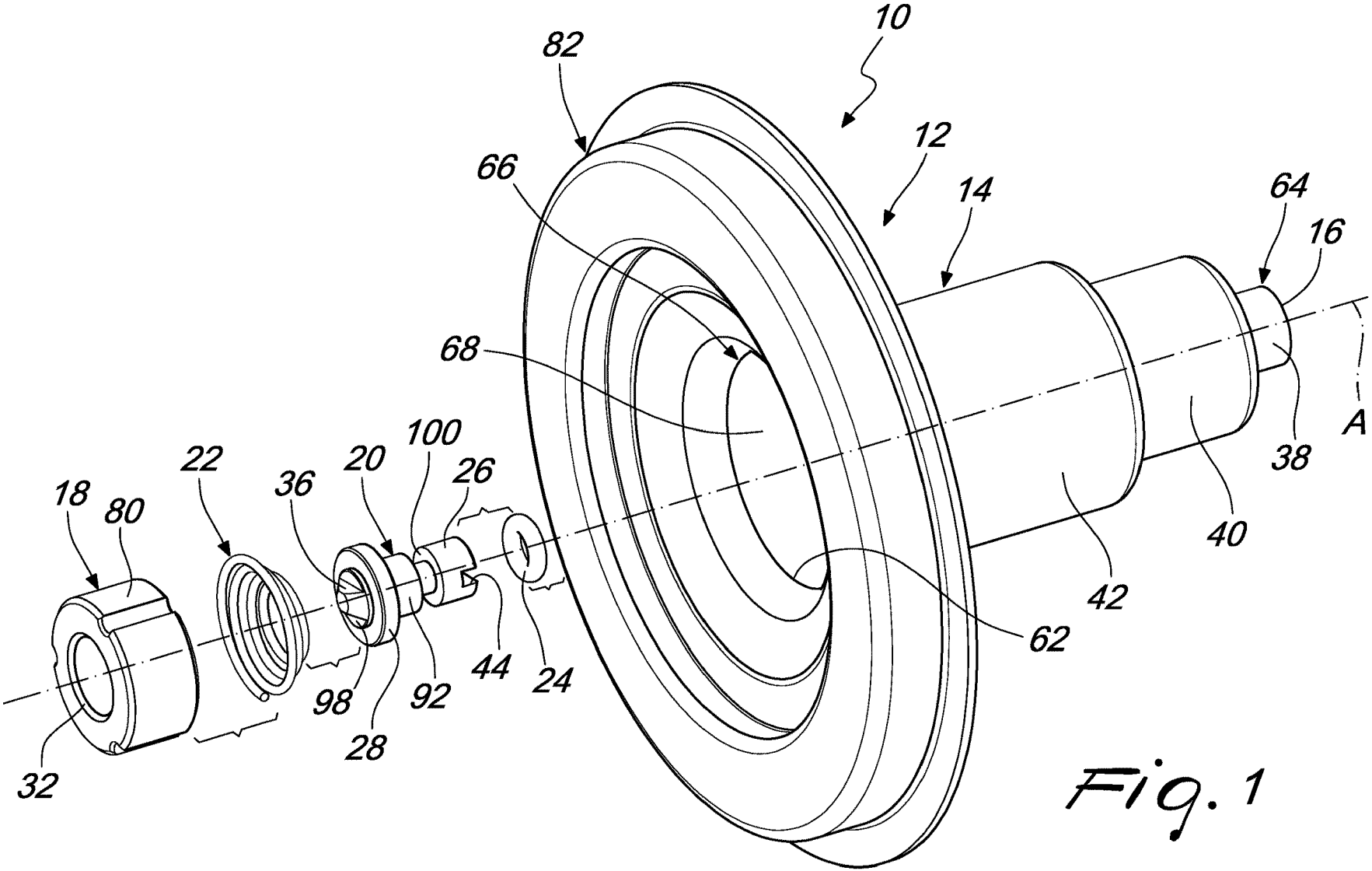
FIG. 1 is an exploded view of a de-blocking device according to the present disclosure.
Figure 2:
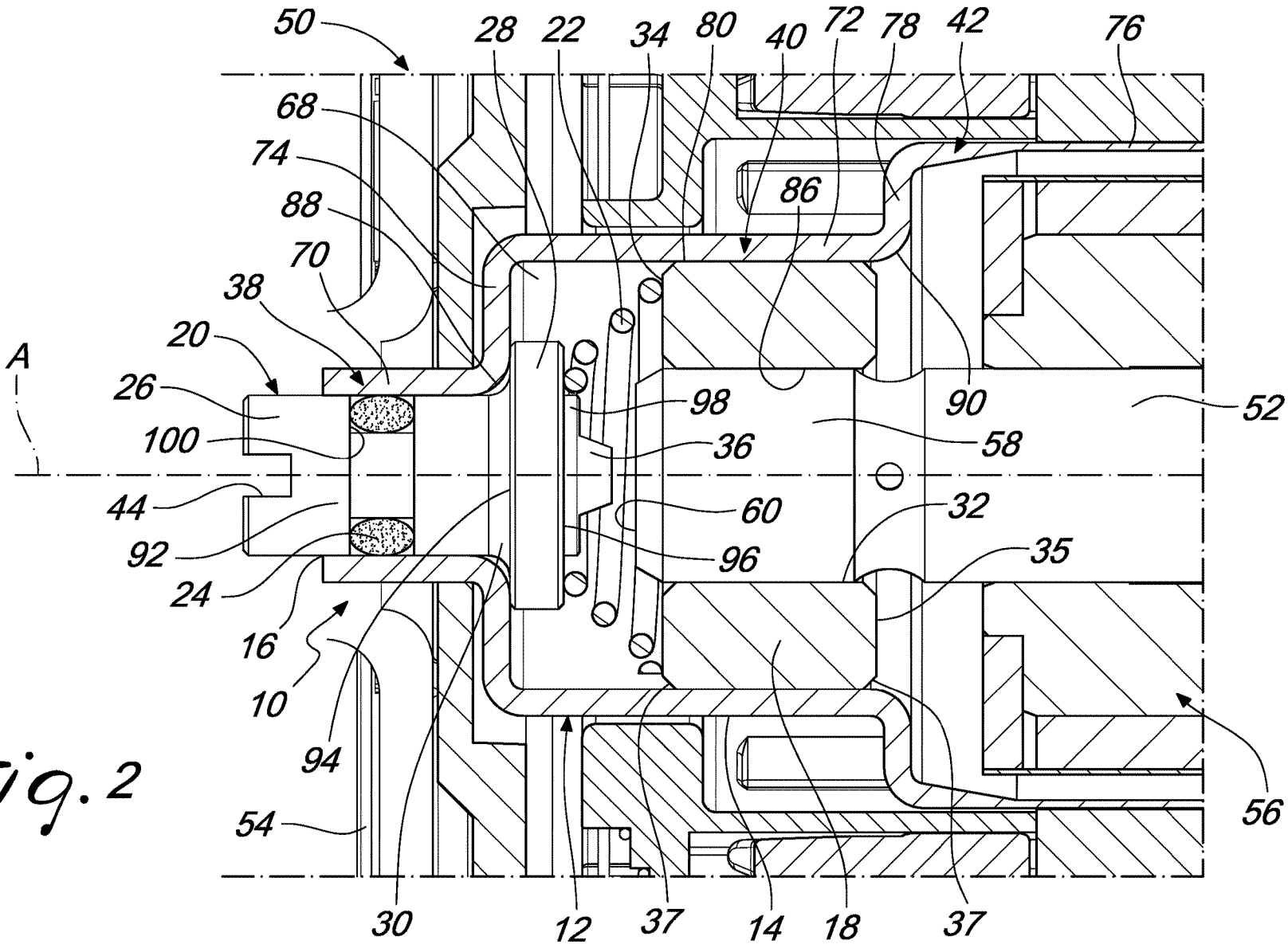
FIG. 2 is a cross-sectional view of the de-blocking device positioned in a pump according to the present disclosure

FIG. 1 illustrates the de-blocking device 10. The de-blocking device 10 comprises a can 12, a bearing 18, a plunger 20 and a biasing element 22. In an embodiment, the de-blocking device 10 further comprises an O-ring 24. FIG. 2 illustrates the de-blocking device 10 positioned in a hydraulic pump 50.

With reference to FIGS. 1 and 2, can 12 is longitudinally extended. The can 12 has a longitudinal axis A. Can 12 is hollow. Can 12 has a conduit 14. Conduit 14 has a through channel 68. In an embodiment, the conduit 14 has a tubular shape.

The conduit 14 is extended longitudinally along the longitudinal axis A. The conduit 14 has a first terminal aperture 16. The first terminal aperture 16 is disposed at the first axial end 64 of the conduit 14. First terminal aperture 16 is disposed at a terminal portion of the can 12. Conduit 14 has a second terminal aperture 62 disposed opposite to the first terminal aperture 16. The second terminal aperture 62 is disposed at the second axial end 66 of the conduit 14.

In general, the can 12 may be a variable thickness can. The can 12 may be made of one single piece of material, in particular metal. Alternatively, the can 12 may be made of several pieces of different thickness. Such pieces could be welded together to form the can 12. The conduit 14 has a first portion 38, a second portion 40 and a third portion 42. Second portion 40 is interposed between the first and second portions 38, 42. The first portion 38, second portion 40 and third portion 42 are mutually coaxial. The first portion 38, second portion 40 and third portion 42 are mutually concentric. Each of the first, second and third portions 38, 40, 42 is hollow. Channel 68 extends through the first, second and third portions 38, 40, 42. Channel 68 may have a varying dimension within the can 12. The longitudinal axis A extends through the respective centers of the first portion 38, the second portion 40 and the third portion 42.

In an embodiment, each of the first, second and third portions 38, 40, 42 may have a cylindrical shape. In reference to FIG. 2, conduit 14 has a first sidewall 70 forming the first portion 38. First sidewall 70 extends substantially parallel to the longitudinal axis A. First sidewall 70 encompasses a portion of the channel 68. Preferably, first sidewall 70 is circular. First sidewall 70 may have a uniform thickness.

Conduit 14 has a second sidewall 72 and a first transverse wall 74 forming the second portion 40. Second sidewall 72 is substantially perpendicular to the first transverse wall 74. Second sidewall 72 extends substantially parallel to the longitudinal axis A. Second sidewall 72 encompasses a portion of the channel 68. Preferably, second sidewall 72 is circular. Preferably, first transverse wall 74 is circular. First transverse wall 74 extends radially away and substantially perpendicular to the longitudinal axis A.

First transverse wall 74 is connected between the first sidewall 70 and the second sidewall 72. A first transition aperture 88 is disposed at the junction of the first transverse wall 74 and the first sidewall 70. The first portion 38 transitions to the second portion 40 at the first transverse wall 74. Second sidewall 72 may have a uniform thickness. First transverse wall 74 may have a uniform thickness.

Conduit 14 has a third sidewall 76 and a second transverse wall 78 forming the third portion 42. Third sidewall 76 is substantially perpendicular to the second transverse wall 78. Third sidewall 76 extends substantially parallel to the longitudinal axis A. Third sidewall 76 encompasses a portion of the channel 68. Preferably, third sidewall 76 is circular. Second transverse wall 78 is circular and extends radially away and substantially perpendicular to the longitudinal axis A.

Second transverse wall 78 is connected between the second sidewall 72 and the third sidewall 76. A second transition aperture 90 is disposed at the junction of the second transverse wall 78 and the second sidewall 72. The second portion 40 transitions to the third portion 42 at the second transverse wall 78. Third sidewall 72 may have a non-uniform thickness. Second transverse wall 78 may have a uniform thickness. Second transverse wall 78 is reduced in length relative to the first transverse wall 74.

The third portion 42 accommodates a rotor 56 of the hydraulic pump 50. Third portion 42 rotatably accommodates the rotor 56. Rotor 56 is disposed so as to rotatable in the third portion 42.

Each of the first, second and third portions 38, 40, 42 have mutually different diameters relative to the longitudinal axis A. The diameter of the first portion 38 is smaller than the respective diameters of the second and third portions 40, 42. The second portion 40 has a larger diameter relative to the diameter of the first portion 38. The second portion 40 has a smaller diameter relative to the diameter of the third portion 42. The third portion 42 has a larger diameter relative to the diameter of the first portion 38. The third portion 42 has a larger diameter relative to the diameter of the second portion 40. The diameter of the channel 68 varies in accordance with the respective portions first, second and third portions 38, 40, 42.

The first terminal aperture 16 is disposed on the first portion 38. The second terminal aperture 62 is disposed on the third portion 42. The first terminal aperture 16 is smaller in diameter relative to the second terminal aperture 62. The respective planes of the first and second terminal apertures 16, 62 are mutually parallel. The respective planes of the first and second terminal apertures 16, 62 are perpendicular to the longitudinal axis A. Channel 68 extends between the first and second terminal apertures 16, 62.

The first transition aperture 88 is smaller in diameter relative to the second transition aperture 90. First transition aperture 88 may have substantially the same diameter as the first terminal aperture 16. The first transition aperture 88 may be smaller in diameter relative to the second terminal aperture 62. The second transition aperture 90 may be larger in diameter relative to the first terminal aperture 16. The second transition aperture 90 may be smaller in diameter relative to the second terminal aperture 62. The respective planes of the first and second terminal apertures 16, 62 and the first and second transition apertures 88, 90 may be mutually parallel. The respective planes of the first and second terminal apertures 16, 62 and the first and second transition apertures 88, 90 may be perpendicular to the longitudinal axis A. Channel 68 extends through the first and second transition apertures 88, 90.

In reference to FIG. 1, can 12 may further comprise a housing 82. Housing 82 *h* is provided for mating of can 12 into a pump body or housing 82. Housing 82 is connected to the second axial end 66 of the conduit 14. Housing 82 may have a plate-like structure.

With reference to FIGS. 1 and 2, the bearing 18 is positioned in the can 12. Bearing 18 is positioned in the conduit 14. Bearing 18 is positioned in the channel 68. Bearing 18 is fixedly positioned in the conduit 14. Bearing 18 has an external wall 80 that engages the inner surface of the wall of the conduit 14. Bearing 18 is positioned such that the external wall 80 is substantially parallel to the internal wall of the conduit 14. In an embodiment, bearing 18 may be fixedly positioned in the conduit 14 by press fit. In an alternative embodiment, the bearing 18 may be locked in position by welding. In particular, bearing 18 may locked in position by be welding a ring in the conduit 14 in front of the bearing 18.

In an embodiment, bearing 18 may be annular in shape. Bearing 18 has a centrally disposed through hole 32. Through hole 32 extends substantially parallel to the longitudinal axis A. Central through hole 32 is encompassed by an internal wall 86. Internal wall 86 is concentric with external wall 82.

Bearing 18 has a diameter that is configured to enable a press fit with the inner surface of the wall of the conduit 14. The diameter of the external wall 80 is greater than the internal wall 86. The diameter of the through hole 32 may be greater than the diameter of the channel 68 in the first portion 38.

The through hole 32 is configured to accommodate a rotor shaft 52 of the rotor 56. Through hole 32 has a diameter configured to accommodate the rotor shaft 52. Rotor shaft 52 has a coupling end 58 for coupling to the bearing 18. Coupling end 58 is inserted into the through hole 32 of the bearing 18 so as to present an abutment surface 60 for abutting engagement with the plunger 20.

Bearing 18 may be spaced from first terminal aperture 16. In an embodiment, the bearing 18 may be positioned in the second portion 40 of the conduit 14. Preferably, bearing 18 is positioned such that the external wall 80 is substantially parallel to the sidewall 72 of the second portion 40. The second portion 40 fixedly accommodates the bearing 18. Bearing 18 may be positioned adjacent the second transverse wall 78 of the conduit 14. Bearing 18 is spaced from the first transition aperture 88. Bearing 18 may be positioned between the first transition aperture 88 and the second transition aperture 90.

The external wall 80 is in contact with the second sidewall 72. The external wall 80 is in press fit engagement with the second sidewall 72. Bearing 18 has a diameter that is configured to enable a press fit with the internal surface of the second sidewall 72.

Bearing 18 has a biasing surface 34 on a side thereof. Biasing surface 34 may be perpendicular to the external wall 80. Biasing surface 34 may be perpendicular to the internal wall 86. Biasing surface 34 may be formed as an annular ring having a limit at an external periphery by the external wall 80 and having a limit at an internal periphery by the internal wall 86. Biasing surface 34 surrounds the opening of the central channel 32. The abutment surface 60 may protrude from the through hole 32 such that the abutment surface 60 is spaced from the biasing surface 34.

Bearing 18 may be positioned such that the biasing surface 34 is substantially perpendicular to the longitudinal axis A. Bearing 18 may be positioned such that the biasing surface 34 is substantially perpendicular to the inner surface of the wall of the conduit 14. Biasing surface 34 may be substantially perpendicular to the longitudinal axis A. Biasing surface 34 may be substantially perpendicular to the sidewall 72 of the second portion 40. Biasing surface 34 is spaced from the first transverse wall 74. Biasing surface 34 may be substantially parallel to the first transverse wall 74. Biasing surface 34 is positioned between the first transverse wall 74 and the second transverse wall 78. Bearing 18 faces the first transition aperture 88.

Bearing 18 has a surface 35 opposite the biasing surface 34. Through hole 32 extends between the surface 35 and the biasing surface 34. Surface 35 may face the second transition aperture 90. Surface 35 may be spaced from the second transition aperture 90. Bearing 18 may have beveled edges 37 between the external wall 80 and the surface 35. Bearing 18 may have beveled edges 37 between the external wall 80 and the biasing surface 34.

The plunger 20 is movably positioned in the can 12. The plunger 20 is movably positioned relative to the bearing 18. The plunger 20 is movably positioned in the conduit 14. Plunger 20 is axially movable in the conduit 14. Plunger 20 is axially movable along the longitudinal axis A. Plunger 20 slidably engages the inner surface of the wall of the conduit 14. In an embodiment, the central axis of the plunger 20 may be parallel to the longitudinal axis A.

First portion 38 slidably accommodates the plunger 20. Plunger 20 is configured to be slidably movable in the first portion 38. Plunger 20 is configured to be slidably engage the first portion 38. Plunger 20 configured to enable a sliding engagement with the internal surface of the first sidewall 70.

Plunger 20 is movably positioned in the conduit 14 between the bearing 18 and the first terminal aperture 16. Plunger 20 comprises a distal end 26 and a proximal end 30. The distal end 26 extends though the first terminal aperture 16. Proximal end 30 is disposed between the bearing 18 and the first terminal aperture 16.

Plunger 20 is orientated such that the proximal end 30 is positioned further into the conduit 14 relative to the distal end 26. The proximal end 30 is positioned closer to the bearing 18 relative to the distal end 26.

Plunger 20 is axially elongated with the distal end 26 and proximal ends 30 being terminal ends. Distal end 26 and proximal ends 30 are at opposite ends of the plunger 20. Plunger 20 may have a substantially tubular body 92. The tubular body 92 may have a diameter that is configured for sliding engagement with the internal surface of the first sidewall 70. Tubular body 92 may substantially occupy the channel 68 in the first portion 38 of the conduit 14.

In an embodiment, the tubular body 92 has a length that is greater than length of the first sidewall 70. The proximal end 30 extends through the first transition aperture 88. The proximal end 30 extends into the second portion 40 of the conduit 14.

The distal end 26 of the plunger 20 has a transversely extended slot 44 substantially perpendicular to the longitudinal axis A. Slot 44 is substantially perpendicular to the tubular body 92. Slot 44 extends linearly across the terminal surface of the distal end 26. Slot 44 extends through the tubular body 92. Slot 44 enables a tool to engage the plunger 20. An axial force may be imparted to the plunger 20 to effect an axial movement. A rotational force may be imparted to the plunger 20 to effect a rotation movement.

The plunger 20 has a collar 28. Collar 28 is extended in a direction substantially perpendicular to the longitudinal axis A. Collar 28 is extended in a direction substantially perpendicular to the tubular body 92. Collar 28 is extended in a direction substantially parallel to the slot 44. Collar 28 is annular shaped. Collar 28 may be formed as a disk. Collar 28 is concentric with the tubular body 92. Collar 28 is coaxial with the tubular body 92.

Collar 28 is disposed at the proximal end 30 of the plunger 20. Collar 28 is positioned in the second portion 40 of the conduit 14. Collar 28 is positioned between the first transition aperture 88 and the bearing 18. Collar 28 has a diameter that is greater than the diameter of the tubular body 92. Collar 28 has a diameter that is greater than the diameter of the first portion 38. Collar 28 has a diameter that is greater than the diameter of the first transition aperture 88. The axial movement of the plunger 20 is restricted by the bearing 18 and the first transverse wall 74 of the second portion 40.

The collar 28 may abut the first transverse wall 74 and the bearing 18. Collar 28 has a abutment face 94 that abuts the internal surface of the first transverse wall 74. Abutment face 94 faces the distal end 26. Abutment face 94 is substantially parallel to the first transverse wall 74. Collar 28 has a biasing face 96 that faces the biasing surface 34 of the bearing 18. Biasing surface 34 is substantially parallel to the biasing surface 34 of the bearing 18.

Plunger 20 has an abutment tip 36. The abutment tip 36 serves to contact the rotor shaft 52. The proximal end 30 is configured to have the abutment tip 36. The abutment tip 36 is axially extended. The abutment tip 36 is axially extended away from the tubular 30. The abutment tip 36 is axially extended away from the distal end 26.

Abutment tip 36 may have a frustoconical shape with a flattened end for abutment with the rotor shaft 52. Abutment tip 36 may have a flattened end for abutment with a abutment surface 60 of the rotor shaft 52. Abutment tip 36 may have four inclined sides. Two opposed sides may be linearly inclined with adjacent sides being curved along a transverse direction.

In an embodiment, the abutment tip 36 may further comprise a base plate 98. Base plate 98 may have a plate-like shape. Base plate 98 is circular. Base plate 98 may support the abutment tip 36. In an embodiment, base plate 98 may be monolithically formed with the abutment tip 36.

In an embodiment, the abutment tip 36 is disposed on the collar 28. The proximal end 30 of the plunger includes the abutment tip 36 and the collar 28. Abutment tip 36 is centrally disposed on the collar 28. The base plate 98 may be centrally disposed on collar 28.

Plunger 20 has an annular groove 100. Annular groove 100 is disposed on the tubular body 92. The annular groove 100 encircles the tubular body 92. Annular groove 100 is disposed between the distal end 26 and the proximal end 36. Annular groove 100 is concentric to the collar 28 and circumvents the central axis of the tubular body 92.

An O-ring 24 is positioned in the annular groove 100. O-ring 24 may protrude from the annular groove 100 so as to have a surface that is spaced from the surface of the tubular body 92. The O-ring 24 engages the internal surface of the first portion 38 so as to provide a sealing engagement. O-ring 24 provides a seal for leakage from the first terminal aperture 16.

The biasing element 22 is positioned between the bearing 18 and the plunger 20. The biasing element 22 is positioned in the second portion 40 of the conduit 14. Biasing element 22 is maintained in position in the channel 68 by the biasing force acting on both the plunger 20 and the bearing 18. Movement of the plunger 20 toward the bearing 18 compresses the biasing element 22. Movement of the plunger 20 toward the bearing 18 increases the biasing force of the biasing element 22. As the bearing 18 is fixedly positioned in the conduit 14, the biasing force acts on the plunger 20. Biasing force pushes the plunger 20 away from the bearing 18.

In an embodiment, the biasing element 22 is positioned between the collar 28 and the bearing 18. The biasing element 22 engages the biasing face 96. Biasing element 22 is positioned about the abutment tip 36. On the opposite end the biasing element 22 engages the biasing surface 34. Biasing element 22 is positioned about the opening of the through hole 32 at the biasing surface 34. Biasing element 22 is positioned about the coupling end 58 of the rotor shaft 52.

In an embodiment biasing element 22 is a coil spring. The coil spring is positioned so as to exert the biasing force in a direction substantially parallel to the longitudinal axis A. The coil spring is positioned on the biasing face 96 so as to surround the abutment tip 36. The abutment tip 36 protrudes through the centre of the coil spring. At the opposite end, the coil spring is positioned on the biasing surface 34 so as to surround the opening of the through hole 32. The coupling end 58 protrudes through the centre of the coil spring. The abutment tip 36 and the abutment surface 60 of the coupling end 58 engages when the plunger 20 is pushed towards the bearing 18. Abutment tip 36 and the abutment surface 60 abuttingly contacts within the coil spring.

With reference to FIG. 2, the hydraulic pump 50 comprises the de-blocking device 10. The hydraulic pump 50 has an enclosure 54 wherein the plunger 20 is externably accessable from the enclosure 54. The hydraulic pump 50 comprises the rotor 56 having the rotor shaft 52. The rotor shaft 52 has the coupling end 58 that is inserted into the through hole 32 of the bearing 18 so as to present the abutment surface 60 for abutting engagement with the plunger 20.

The biasing force of the biasing element 22 maintains the plunger 20 away from the bearing 18. The plunger 20 is pushed by the biasing element 22 such that the collar 28 abuts the first transverse wall 74. When the rotor 56 becomes blocked, a de-blocking procedure involves the actuation of the plunger 20 to free the rotor 56. The plunger 20 is actuated by an axial force that acts in opposition to the biasing force of the biasing element 22. When the force on the plunger 20 exceeds the biasing force the plunger 20 moves towards the bearing 18 and the coupling end 58 of the rotor 56 till the abutment tip 36 abuts the abutment surface 60. The abutting engagement imparts a linear force to the rotor shaft 52 thereby de-blocking the rotor 56. The plunger 20 may be rotated by using an appropriate tool to engage the slot 44 so as to impart a rotational force to the plunger 20 in order to de-block the rotor 56.

The skilled person would appreciate that foregoing embodiments may be modified or combined to obtain the de-blocking device 10 of the present disclosure.

INDUSTRIAL APPLICABILITY

This disclosure describes a de-blocking device 10 for de-blocking of a rotor 56 in a hydraulic pump 50. The de-blocking device 10 is actuatable axially and rotationally. De-blocking device 10 is actuated to abuttingly engage the rotator shaft 52 so to impart a force to the rotor shaft 52. The abutting engagement results in a movement of the rotor shaft thereby effecting a release of the blocked rotor shaft 52. The de-blocking device 10 is externally actuatable to impart the de-blocking force to the rotor shaft 52. The de-blocking force may be an axial force and/or a rotational force.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein.

Where technical features mentioned in any claim are followed by reference signs, the reference signs have been included for the sole purpose of increasing the intelligibility of the claims and accordingly, neither the reference signs nor their absence have any limiting effect on the technical features as described above or on the scope of any claim elements.

One skilled in the art will realise the disclosure may be embodied in other specific forms without departing from the disclosure or essential characteristics thereof. The foregoing embodiments are therefore to be considered in all respects illustrative rather than limiting of the disclosure described herein.

The invention claimed is:

1. A de-blocking device for a hydraulic pump, the de-blocking device comprising:

a can having a longitudinal axis and a conduit extending longitudinally along the longitudinal axis, the conduit having a first terminal aperture;

a bearing fixedly positioned in the conduit spaced from the first terminal aperture, a plunger axially movably positioned in the conduit between the bearing and the first terminal aperture; and a biasing element positioned between the bearing and the plunger wherein the movement of the plunger toward the bearing compresses the biasing element.

2. The de-blocking device of claim 1 wherein the can is a variable thickness can wherein the conduit has a first portion for slidably accommodating the plunger.

3. The de-blocking device of claim 1 wherein the conduit further comprises a second portion, the second portion being concentric to the first portion wherein the second portion has a larger diameter relative to the first portion.

4. The de-blocking device of claim 1, wherein the conduit further comprises a third portion for rotatably accommodating a rotor of the hydraulic pump, the third portion being concentric to the first and second portions wherein the third portion has a larger diameter relative to the second portion.

5. The de-blocking device of claim 1 wherein the plunger has a distal end, the distal end having a transversely extended slot substantially perpendicular to the longitudinal axis.

6. The de-blocking device of claim 1 wherein the plunger has a collar extended in a direction substantially perpendicular to the longitudinal axis, the biasing element being positioned between the collar and the bearing.

7. The de-blocking device of claim 6 wherein the collar is disposed at the proximal end of the plunger.

8. The de-blocking device of claim 6 wherein the proximal end is configured to have an axially extended abutment tip.

9. The de-blocking device of claim 1 wherein the bearing has a centrally disposed through hole.

10. The de-blocking device of claim 9 wherein the bearing has a biasing surface surrounding the opening of the through hole wherein the biasing element is positioned on the biasing surface.

11. The de-blocking device of claim 1 wherein the biasing element is a coil spring.

12. The de-blocking device of claim 11, wherein the coil spring is positioned so as to exert a biasing force substantially parallel to the longitudinal axis.

13. A hydraulic pump comprising the de-blocking device of claim 1.

14. The hydraulic pump of claim 13 having further comprising an enclosure wherein the plunger is externably accessable from the enclosure.

15. The hydraulic pump of claim 13 wherein the hydraulic pump comprises a rotor having a rotor shaft, the rotor shaft having a coupling end being inserted into a through hole of the bearing so as to present an abutment surface for abutting engagement with the plunger.

* * * * *